US009377236B2

(12) United States Patent
Hinde et al.

(10) Patent No.: US 9,377,236 B2
(45) Date of Patent: Jun. 28, 2016

(54) CO2 REFRIGERATION SYSTEM WITH HOT GAS DEFROST

(71) Applicant: Hill Phoenix, Inc., Conyers, GA (US)

(72) Inventors: David K. Hinde; J. Scott Martin, Conyers, GA (US); Kim Christensen, Aarhus V (DK); John D. Bittner, Bethlehem, GA (US)

(73) Assignee: Hilll Phoenix, Inc., Conyers, GA (US)

( * ) Notice: Subject to any disclaimer, the term of this patent is extended or adjusted under 35 U.S.C. 154(b) by 225 days.

(21) Appl. No.: 14/359,228

(22) PCT Filed: Nov. 16, 2012

(86) PCT No.: PCT/US2012/065522

§ 371 (c)(1),
(2) Date: May 19, 2014

(87) PCT Pub. No.: WO2013/078088

PCT Pub. Date: May 30, 2013

(65) Prior Publication Data

US 2014/0352343 A1 Dec. 4, 2014

Related U.S. Application Data

(60) Provisional application No. 61/562,162, filed on Nov. 21, 2011.

(51) Int. Cl.
*F25D 21/06* (2006.01)
*F25B 7/00* (2006.01)
(Continued)

(52) U.S. Cl.
CPC . *F25D 21/06* (2013.01); *F25B 1/10* (2013.01); *F25B 5/02* (2013.01); *F25B 7/00* (2013.01);
(Continued)

(58) Field of Classification Search
CPC ..... F25B 1/10; F25B 5/02; F25B 9/008; F25B 47/022; F25B 7/00; F25B 21/06; F25B 41/043; F25B 2309/061; F25B 2341/066; F25B 2400/075; F25B 2400/23; F25B 2600/2509; F25B 2600/2517; F25B 2600/2519; F25D 21/06
USPC ..... 62/277, 80, 81
See application file for complete search history.

(56) References Cited

U.S. PATENT DOCUMENTS 3,074,249 A * 1/1963 Henderson ..... F25B 1/10 62/149
3,184,926 A * 5/1965 Blake ..... F25B 1/10 62/155

(Continued)

FOREIGN PATENT DOCUMENTS

WO WO-2009/052369 A2 4/2009
WO WO-2009/127062 A1 10/2009
WO WO-2011/049767 4/2011

OTHER PUBLICATIONS

International Preliminary Report on Patentability for PCT Application No. PCT/US2012/065522, dated May 27, 2014, 8 pages.

(Continued)

*Primary Examiner* — Mohammad M Ali
(74) *Attorney, Agent, or Firm* — Foley & Lardner LLP

(57) ABSTRACT

A C02 refrigeration system has an LT system with LT compressors and LT evaporators, and an MT system with MT compressors and MT evaporators, operating in a refrigeration mode and a defrost mode using C02 hot gas discharge from the MT and/or the LT compressors to defrost the LT evaporators. A C02 refrigerant circuit directs C02 refrigerant through the system and has an LT compressor discharge line with a hot gas discharge valve, a C02 hot gas defrost supply header directing C02 hot gas discharge from the LT and/or the MT compressors to the LT evaporators, a flash tank supplying C02 refrigerant to the MT and LT evaporators during the refrigeration mode, and receiving the C02 hot gas discharge from the LT evaporators during the defrost mode, and a control system directing the C02 hot gas discharge through the LT evaporators and to the flash tank during the defrost mode.

21 Claims, 6 Drawing Sheets

(51) Int. Cl.

| | |
|---|---|
| ***F25B 1/10*** | (2006.01) |
| ***F25B 5/02*** | (2006.01) |
| ***F25B 9/00*** | (2006.01) |
| ***F25B 47/02*** | (2006.01) |
| *F25B 41/04* | (2006.01) |

(52) U.S. Cl.
CPC ..... *F25B 9/008* (2013.01); *F25B 47/022* (2013.01); *F25B 41/043* (2013.01); *F25B 2309/061* (2013.01); *F25B 2341/066* (2013.01); *F25B 2400/075* (2013.01); *F25B 2400/23* (2013.01); *F25B 2600/2509* (2013.01); *F25B 2600/2517* (2013.01); *F25B 2600/2519* (2013.01)

(56) References Cited

U.S. PATENT DOCUMENTS

| | | | | | |
|---|---|---|---|---|---|
| 3,358,469 | A * | 12/1967 | Quick | F25B 5/02 | 62/183 |
| 3,766,745 | A * | 10/1973 | Quick | F25B 1/00 | 62/196.2 |
| 4,167,102 | A * | 9/1979 | Willitts | F25B 5/02 | 62/152 |
| 4,454,725 | A * | 6/1984 | Cann | F24D 15/04 | 62/117 |
| 4,589,263 | A * | 5/1986 | DiCarlo | F25B 5/02 | 62/193 |
| 4,621,505 | A * | 11/1986 | Ares | F25B 5/02 | 62/196.4 |
| 4,660,384 | A * | 4/1987 | Pallanch | F25B 47/022 | 62/151 |
| 5,400,615 | A * | 3/1995 | Pearson | F25B 25/005 | 62/277 |
| 5,596,878 | A * | 1/1997 | Hanson | B60H 1/00007 | 62/160 |
| 6,170,272 | B1 | 1/2001 | Backman | | |
| 7,610,766 | B2 * | 11/2009 | Dube | F25B 5/02 | 62/151 |
| 9,261,299 | B2 * | 2/2016 | Porter | F25B 49/02 | |
| 2005/0257564 | A1 * | 11/2005 | Wightman | F25B 41/04 | 62/510 |
| 2009/0260389 | A1 | 10/2009 | Dube | | |
| 2010/0205984 | A1 | 8/2010 | Gu et al. | | |
| 2011/0154840 | A1 | 6/2011 | Mihara et al. | | |

OTHER PUBLICATIONS

International Search Report and Written Opinion for PCT Application No. PCT/US2012/065522, mail date Feb. 8, 2013, 9 pages.
Extended European Search Report for EP Application No. 12851221.7, mailed Aug. 19, 2015, 6 pages.

* cited by examiner 1
2
3
4
5
9
8
10
11
10
11
13
14
15
13
14
15
17
16
18
19
18
19
20
21

1
2
3
4
5
6
7
8
9
10
11
13
14
15
16
17
18
19
20
21
Open
Closed

CO2 REFRIGERATION SYSTEM WITH HOT GAS DEFROST

CROSS REFERENCE TO RELATED APPLICATIONS

The present Application claims the benefit of priority under 35 U.S.C. §119(e)(1) of U.S. Provisional Patent Application No. 61/562,162, titled "CO2 Refrigeration System With Hot Gas Defrost" and filed on Nov. 21, 2011, the complete disclosure of which is incorporated herein by reference.

BACKGROUND

This section is intended to provide a background or context to the invention recited in the claims. The description herein may include concepts that could be pursued, but are not necessarily ones that have been previously conceived or pursued. Therefore, unless otherwise indicated herein, what is described in this section is not prior art to the description and claims in this application and is not admitted to be prior art by inclusion in this section.

The present invention relates generally to the field of a refrigeration system primarily using CO2 as a refrigerant. The present invention relates more particularly to a CO2 refrigeration system using hot gas to provide defrost of evaporators.

Refrigeration systems typically operate at evaporator temperatures below the dewpoint of the air they are cooling and as such, frost is formed on the surface of the evaporator. Frost buildup on the evaporator reduces the heat transfer effectiveness of the heat exchanger and so the evaporators periodically go through a defrost cycle to remove the frost and return the heat transfer surface to a more optimal state.

Various methods to defrost evaporators are used and include time-off defrost, electric defrost, and hot gas defrost. Time-off defrost is considered a passive defrost system—the refrigeration system is turned off and the air moving across the evaporator provides the defrosting action—this method is generally only suitable for medium-temperature systems (evaporator temperatures greater than +15° F. or −10° C.). Electric and hot gas defrost, considered "active" or "forced" defrost methods, are typically suitable for both low- and medium-temperature refrigeration systems.

For electric defrost, an electric heater is located within or adjacent to the coil and heat flows into the evaporator either by conduction or convection by movement of air. This method requires additional wiring to be installed and additional electrical power to be used and many consider the extra installation and operating cost to be a drawback of this method.

For hot gas defrost, gas from the compressor discharge or other locations on the high-side of the system is typically passed through the coil either in a forward or reverse direction. The gas typically condenses to a liquid form inside the evaporator effectively heating the tubes from within—this is due primarily to the condensing temperature of the gas being above the freezing point of the frost (+32° F. or 0° C.). Hot gas defrost is generally considered less expensive to install and operate, but the pressure increase in the coil during the defrost cycle tends to raise concerns about long-term structural integrity (e.g. leak-tightness of the coil—it is believed that leaks can occur over time due to fatigue of the coil materials or joints).

Refrigeration systems utilizing carbon dioxide ("CO2" from here on) as the refrigerant are typically operated with electric defrost on the low-temperature system. Hot gas defrost has traditionally not been used in CO2 refrigeration systems because the pressure of the compressor discharge gas on the low-temperature side of the system is below the melting point of the frost (typical condensing temperature of approximately +20° F. or −7° C.) and therefore CO2 gas could only be desuperheated in the coil rather than condensing and a much smaller amount of heat would be available in the evaporator for defrosting purposes.

Accordingly, it would be desirable to provide a hot gas defrost system for a CO2 refrigeration system.

SUMMARY

One embodiment of the disclosure relates to a hot gas defrost system a CO2 refrigeration system having a low temperature ("LT") system portion and/or a medium temperature ("MT") system portion. During defrost, the discharge pressure on the compressor is raised using a hot gas discharge valve and CO2 refrigerant hot gas is directed through the defrosting evaporator where full or partial condensation is realized and liquid CO2 refrigerant is returned to a flash tank where pressure is controlled by flash gas bypass valve. The hot gas discharge valve raises the compressor's discharge pressure above the pressure in the flash tank to establish a system pressure differential that directs the CO2 refrigerant from the compressor, through the defrosting LT evaporators and/or MT evaporators (in either or a reverse or forward flow direction) and to the flash tank. The hot gas discharge valve may be mechanical or electrical and may include multiple valves in parallel that regulate the discharge pressure of only one, or multiple, or all of the LT compressors. The pressure in the flash tank is raised by the flash gas bypass valve to obtain higher CO2 refrigerant condensing pressure and temperature in the evaporator being defrosted to increase the speed of the defrost cycle. A control system coordinates operation of the hot gas discharge valve and the flash gas bypass valve so that a differential pressure is maintained between the compressors and the flash tank to drive the flow of CO2 refrigerant discharge gas through the evaporators being defrosted.

Another embodiment of the disclosure relates to a hot gas defrost system designed for a CO2 refrigeration system. Raising the pressure of the high-side of the system to a condensing pressure above the freezing point would generally require pressures which were previously considered too high for use with conventional refrigeration system components. For example, in order to have a CO2 hot gas condensing temperature within the evaporator of approximately +38° F. or +3° C. the corresponding pressure would be approximately 535 psig (about 38 bar). This disclosure details a hot gas defrost system designed for a CO2 refrigeration system having components with increased pressure capabilities.

In an embodiment of the disclosure the discharge pressure on the defrost compressor (single or multiple) 20 is controlled and raised using the hot gas defrost valve 21 and CO2 hot-gas discharged from the compressor is directed through the defrosting evaporator 14 where full or partial condensation is realized and liquid CO2 is returned to the receiver or flash tank 4 where pressure is controlled by a flash gas bypass valve 5.

In an embodiment of the disclosure the hot gas discharge valve operates during defrost to raise the compressor's discharge pressure above the pressure in the flash tank for the purposes of establishing a pressure differential in the system that drives the hot gas in a flow configuration (either forward or reverse direction) that defrosts the LT and/or MT evaporator(s) and returns the CO2 in a condensed liquid state to the flash tank. The hot gas discharge valve could be either a mechanical or electrical valve and may include multiple valves in parallel, and with a combination of mechanical and/or electrical control, and operates to regulate the discharge pressure of only one, multiple, or all of the compressors.

In an embodiment of the disclosure a control system or device operates the flash gas bypass valve to raise the pressure in the flash tank during the defrost mode to obtain higher CO2 condensing pressure and temperature in the evaporator(s) being defrosted for more effective defrost or to increase speed of the defrost mode.

In one embodiment of the disclosure a control system or device coordinates the pressure regulation of the hot gas discharge valve with the pressure regulation of the flash gas bypass valve such that the operation of the two valves maintains a substantially constant differential pressure during the defrost operation (i.e. higher pressure to lower pressure) between the compressors and the flash tank to drive the flow of CO2 hot gas through the evaporators being defrosted.

BRIEF DESCRIPTION OF THE DRAWINGS

The disclosure will become more fully understood from the following detailed description, taken in conjunction with the accompanying figures, wherein like reference numerals refer to like elements, in which.

DETAILED DESCRIPTION

Referring to the FIGURES, a CO2 refrigeration system is shown equipped with hot gas defrost capability on the low-temperature (LT) system portion, which includes a CO2 refrigerant LT circuit with conduits, piping, etc. and other components such as one or more low temperature (LT) compressor(s) and one or more low temperature (LT) evaporator(s), according to an exemplary embodiment. During the defrost mode, high pressure CO2 hot gas from the LT compressor discharge is passed in a reverse flow configuration through the circuit, including the coil of the LT evaporator(s), and returned to a pressure vessel operating as a receiver, liquid-vapor separator or "flash tank" which maintains a supply of liquid CO2 refrigerant in a lower portion and vapor CO2 refrigerant in an upper portion at a pressure of approximately 38 bar (about 540 psig) with a saturation temperature of approximately 38° F., according to an exemplary embodiment. According to alternative embodiments, the high pressure CO2 hot gas refrigerant could be routed through the circuit in a forward flow configuration by providing suitable valves. According to other illustrated embodiments, during the defrost mode, high pressure CO2 hot gas from the MT compressor discharge can be used to at least partially supplement CO2 hot gas from the LT compressors, or CO2 hot gas defrost from the MT compressor discharge may be used solely as the source of heat for defrosting the LT evaporator(s). All such embodiments are intended to be within the scope of this disclosure.

Figure 1:
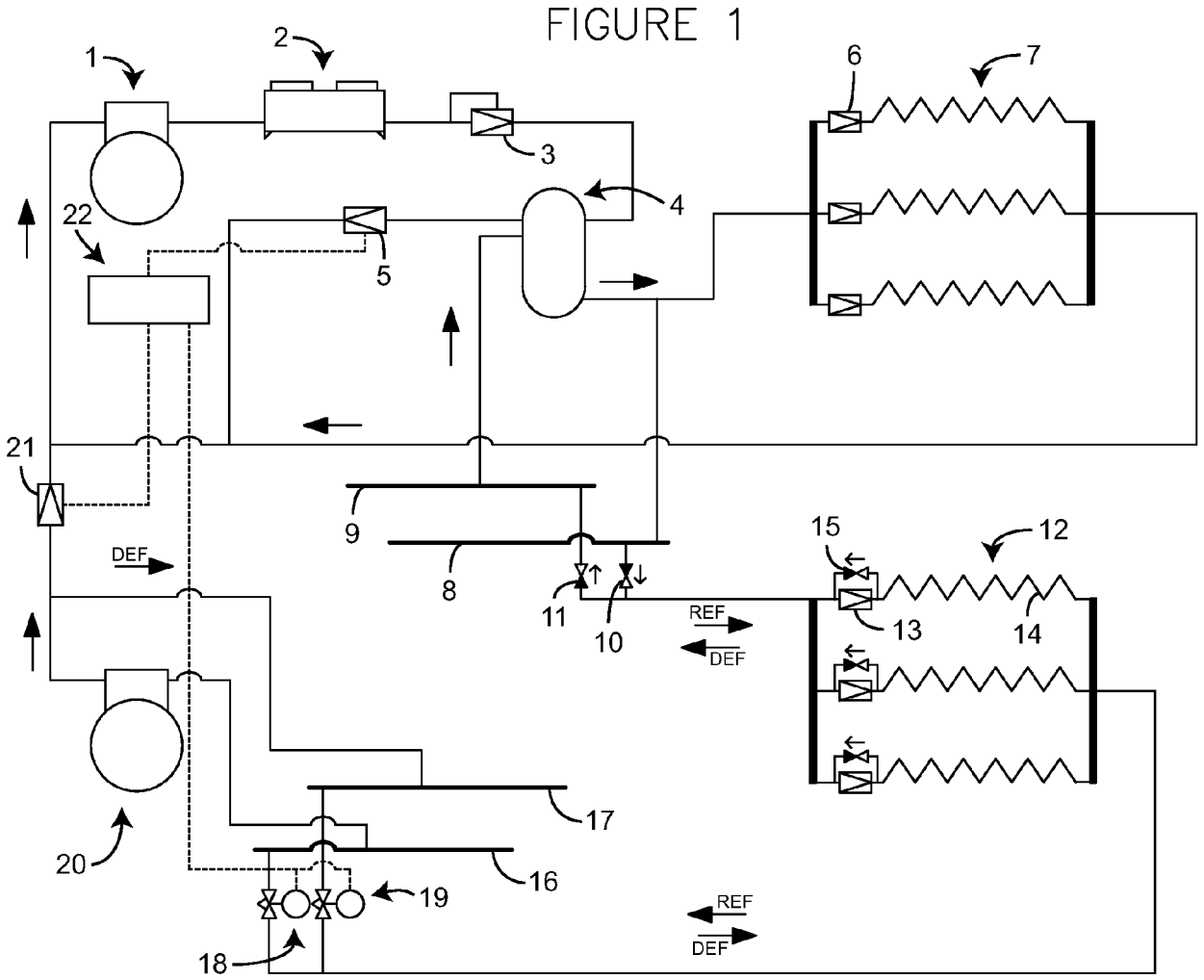
FIG. 1 is a schematic representation of a CO2 refrigeration system having a low temperature system portion and a medium temperature system portion, where the low temperature system includes hot gas defrosting capability, according to an exemplary embodiment described herein.
Figure 3A:
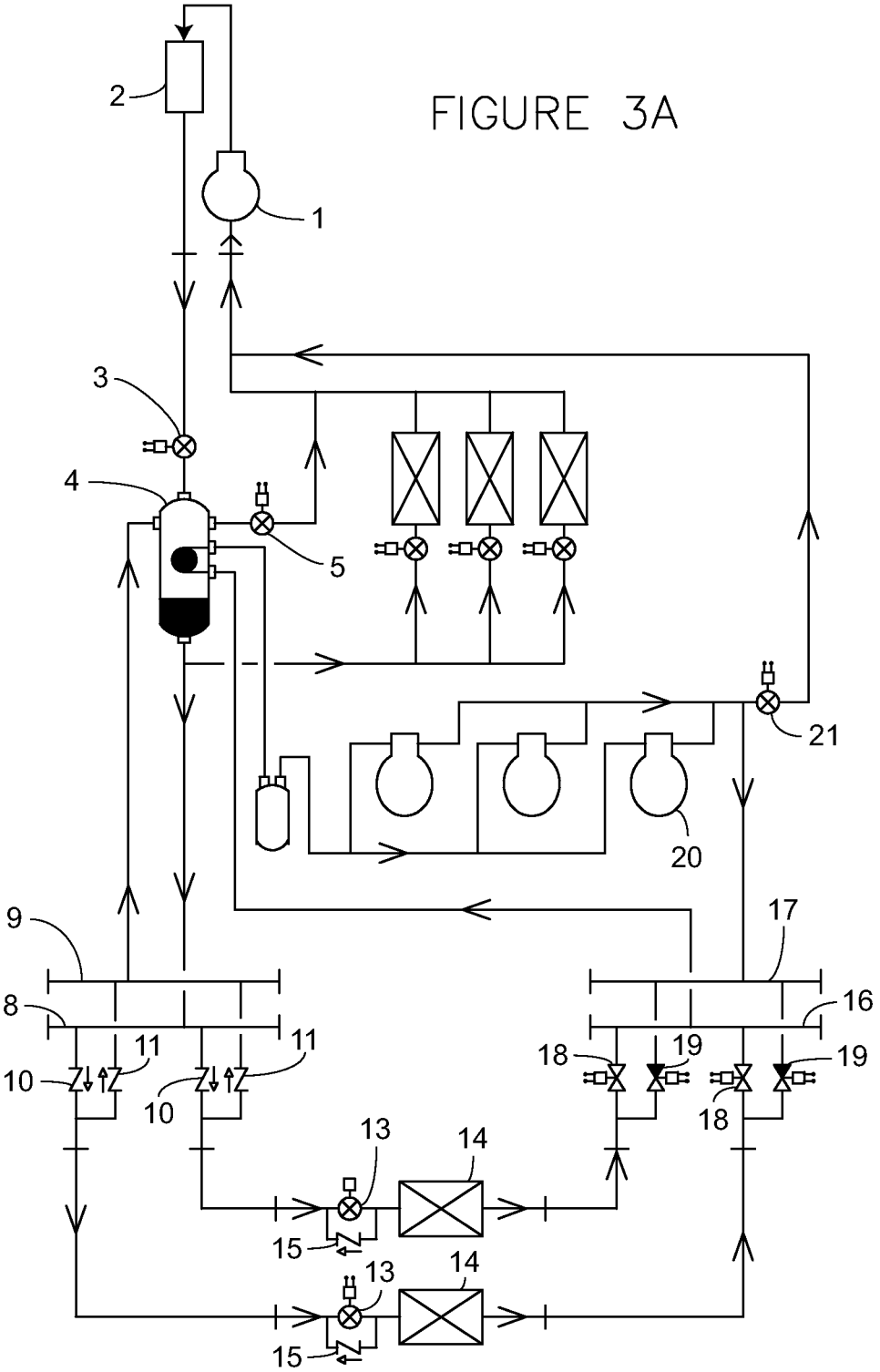
FIG. 3A is a more detailed schematic representation of a CO2 refrigeration system having a low temperature system portion and a medium temperature system portion, where the low temperature system includes hot gas defrosting capability, and the system is shown operating in a refrigeration mode, according to an exemplary embodiment described herein.

Referring more particularly to FIGS. 1 and 3A, the CO2 refrigeration system with hot gas defrost is shown in additional detail according to an exemplary embodiment. The CO2 refrigeration system also includes a medium-temperature (MT) system portion, which includes a CO2 refrigerant MT circuit with conduits, piping, etc. and other components such as one or more medium temperature (MT) compressor(s) 1 (which may operate in a transcritical mode) and one or more medium temperature (MT) evaporator(s). High pressure CO2 discharge gas leaves the MT compressors 1 and flows to a heat exchanger shown as a gas cooler 2 where the CO2 refrigerant is cooled (if system operation is in the supercritical region) or condensed (if system operation is in the sub-critical region). The cooled CO2 refrigerant from the gas cooler 2 enters a high pressure control valve 3 (such as, for example, a high pressure expansion valve) and is expanded down to a pressure of approximately 38 bar (about 540 psig) before entering the flash tank 4. Liquid and vapor CO2 refrigerant are separated in the flash tank 4. The liquid CO2 refrigerant from a lower portion of flash tank 4 is directed through the circuit to a CO2 liquid header 8, then through a liquid refrigerant supply solenoid valve 10 and then to the LT evaporators 12.

During a refrigeration mode of system operation, the liquid refrigerant supply solenoid 10 is open and liquid CO2 refrigerant flows through an expansion device 13 then into the coil 14 of the LT evaporators to refrigerate an associated display case or coil. The CO2 refrigerant then exits the coil 14 as a superheated CO2 vapor and flows back to a refrigerant return suction valve 18, then into a return suction header 16 then to the LT compressor 20. The CO2 refrigerant vapor is compressed in the LT compressor up to a pressure of approximately 425 psig (about 30 bar) with a saturation temperature of approximately 23° F. (about −5° C.). The hot CO2 discharge gas then flows from LT compressor 20 through a hot gas discharge valve 21 which during the refrigeration mode is intended to operate in the fully-open state to provide minimal pressure drop, preferably on the order of about <10 psid (approximately <0.7 bar).

During the refrigeration mode of system operation, CO2 liquid refrigerant from the flash tank 4 is also directed to the MT evaporators 7 which are also equipped with expansion devices 6. According to one embodiment, the CO2 refrigerant is fully evaporated in the MT evaporators and the suction CO2 gas from the MT evaporators is returned back to the system at a pressure of approximately 425 psig (about 30 bar). Also, CO2 refrigerant vapor in the flash tank 4 is directed through a flash gas bypass valve 5 on an as-needed basis to maintain pressure control within the flash tank 4. The flash gas bypass valve expands the CO2 refrigerant gas down to a pressure that is approximately equal to the pressure of the CO2 refrigerant gas that is returning from the medium-temperature evaporators 7 and these two flows are mixed with each other and also with the discharge CO2 refrigerant gas that is leaving the hot gas discharge valve 21, on the return to (i.e. suction side of) the MT compressors.

Figure 3B:
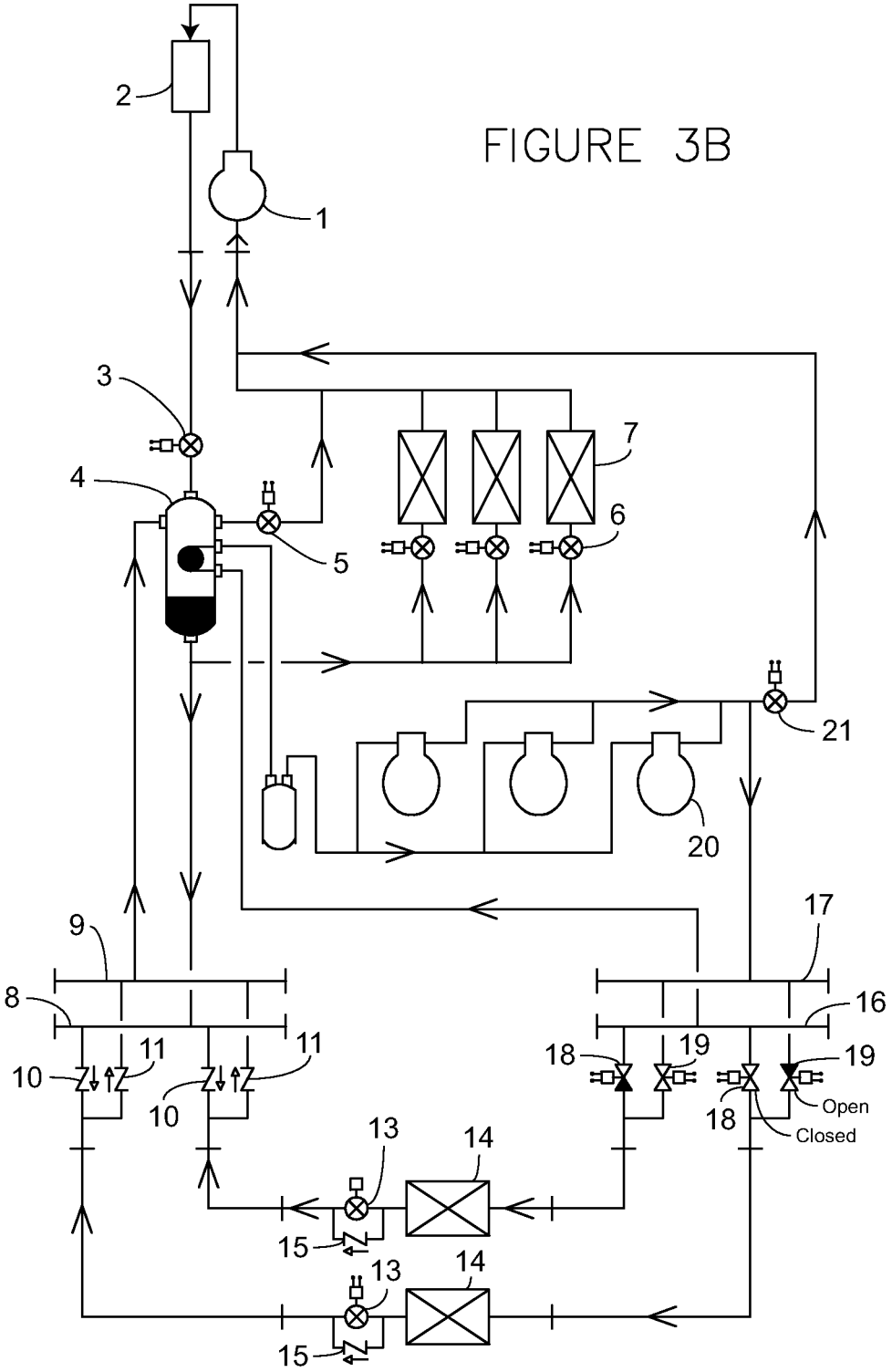
FIG. 3B is a more detailed schematic representation of a CO2 refrigeration system having a low temperature system portion and a medium temperature system portion, where the low temperature system includes hot gas defrosting capability, and the system is shown operating in a defrost mode for evaporators in the low temperature system portion, according to an exemplary embodiment described herein.

Referring to FIGS. 1 and 3B, during the defrost cycle or defrost mode of system operation, the hot gas discharge valve 21 is regulated to a partially (or in some embodiments, fully) closed position in order to regulate the LT compressor discharge pressure at a higher pressure than the suction CO2 refrigerant gas that is returning (i.e. exiting) from the medium-temperature evaporators, and also at a higher pressure than the pressure of the CO2 refrigerant maintained in the flash tank 4, which is preferably approximately 560 psig (about 40 bar) and a saturation temperature of approximately 41° F. (about +5° C.), according to an exemplary embodiment.

During defrost operation, the LT circuit flow path is reconfigured so that a portion of the CO2 refrigerant discharge hot gas (or in some embodiments, all the CO2 refrigerant discharge hot gas) is directed from LT compressor 20 to a hot gas defrost header 17 and through a hot gas defrost valve 19 which is opened during defrost, and the suction valve 18 is in the closed position, so that the CO2 discharge hot gas is directed in a reverse flow configuration to the coil 14 of the LT evaporator 12 requiring defrost. Inside the frosted coil 14 of the LT evaporator 12, the CO2 discharge hot gas is cooled and condensed as the frost on the evaporator melts and absorbs heat from the CO2 refrigerant. The cooled CO2 refrigerant then exits the coil 14 and bypasses the expansion device 13 through a parallel bypass check valve 15 or other suitable type valve. The cooled CO2 refrigerant is then returned to the system through the defrost return solenoid valve (or check valve) 11 which has been opened (and where the liquid supply solenoid valve (or check valve) 10 has been closed). The CO2 refrigerant then enters a defrost return manifold 9 and is then directed back to the flash tank 4. The LT circuit valves (10, 11, 18, and 19) remain in these positions until the coil 14 of the LT evaporator 12 reaches a predetermined termination temperature at which point the defrost mode of operation is terminated and the hot gas supply solenoid valve 19 and hot gas return valve 11 are closed. After a timed 'drip cycle', the suction valve 18 is opened to return the evaporator to a low pressure state and the liquid supply valve 10 is re-opened to return the LT system portion to the refrigeration mode of operation.

Although the components and operation of the system have been shown and described with reference to hot gas defrosting of the LT system portion, the system may also be used to defrost either LT evaporators, or MT evaporators, or both. Further, although the flow configuration during defrost operation is shown in a reverse flow direction, the flow configuration could be either in a forward or reverse direction, however operation in a forward flow direction would require additional valving and controls. Accordingly, all such variations are intended to be within the scope of this disclosure.

Figure 2:
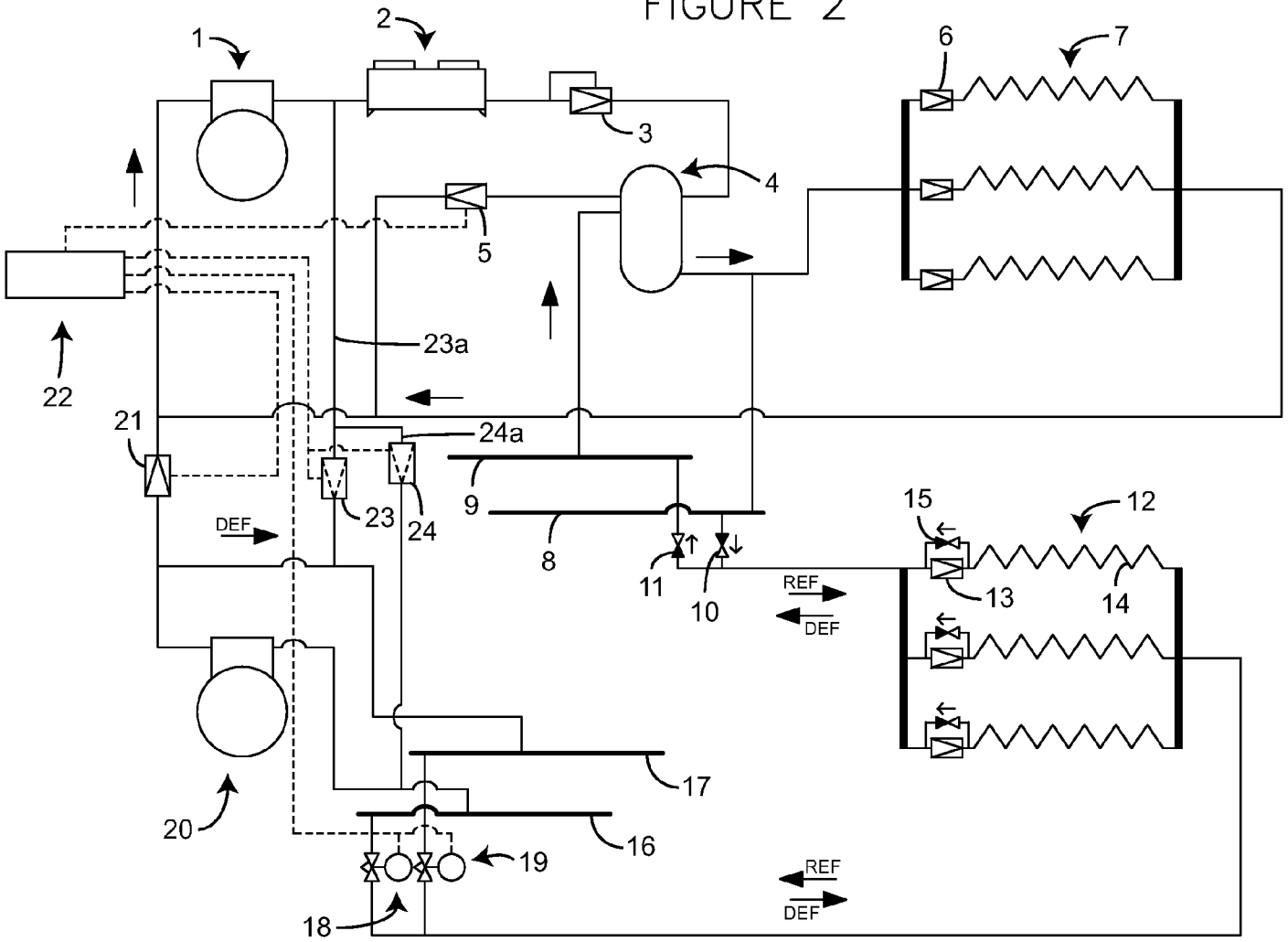
FIG. 2 is a schematic representation of a CO2 refrigeration system having a low temperature system portion and a medium temperature system portion, where the low temperature system may receive hot gas from the medium temperature compressors as part of the hot gas defrosting capability, according to an exemplary embodiment described herein.

Referring now to FIG. 2, the CO2 refrigeration system with hot gas defrost is shown according to an exemplary embodiment. The illustrated embodiment of FIG. 2 is similar to the embodiment of FIG. 1, but includes two additional branch lines 23*a* and 24*a* extending from the discharge of the MT compressor 1, each branch line 23*a* and 24*a* including valves 23 and 24 respectively (e.g. solenoid valve, etc.). According to one embodiment, solenoid valve 23 is configured to permit CO2 hot gas from the MT compressor 1 discharge to flow to the LT compressor 20 discharge during the defrost mode to provide an additional heat source for defrosting coils 14. The solenoid valve 23 is intended to permit delivery of sufficient CO2 hot gas to melt the frost on the coils 14 of evaporators 12 during the defrost mode. Branch line 24*a* is configured to permit CO2 hot gas from the MT compressor 1 discharge to flow to the LT compressor 20 suction, and solenoid valve 24 is intended to regulate as necessary to ensure continuous and stable operation of the LT compressor 20 during the defrost mode by sending CO2 gas to the suction side of the LT compressor 20 when the LT compressor 20 is "starving" or otherwise requires additional suction gas to maintain proper operation.

Figure 4A:
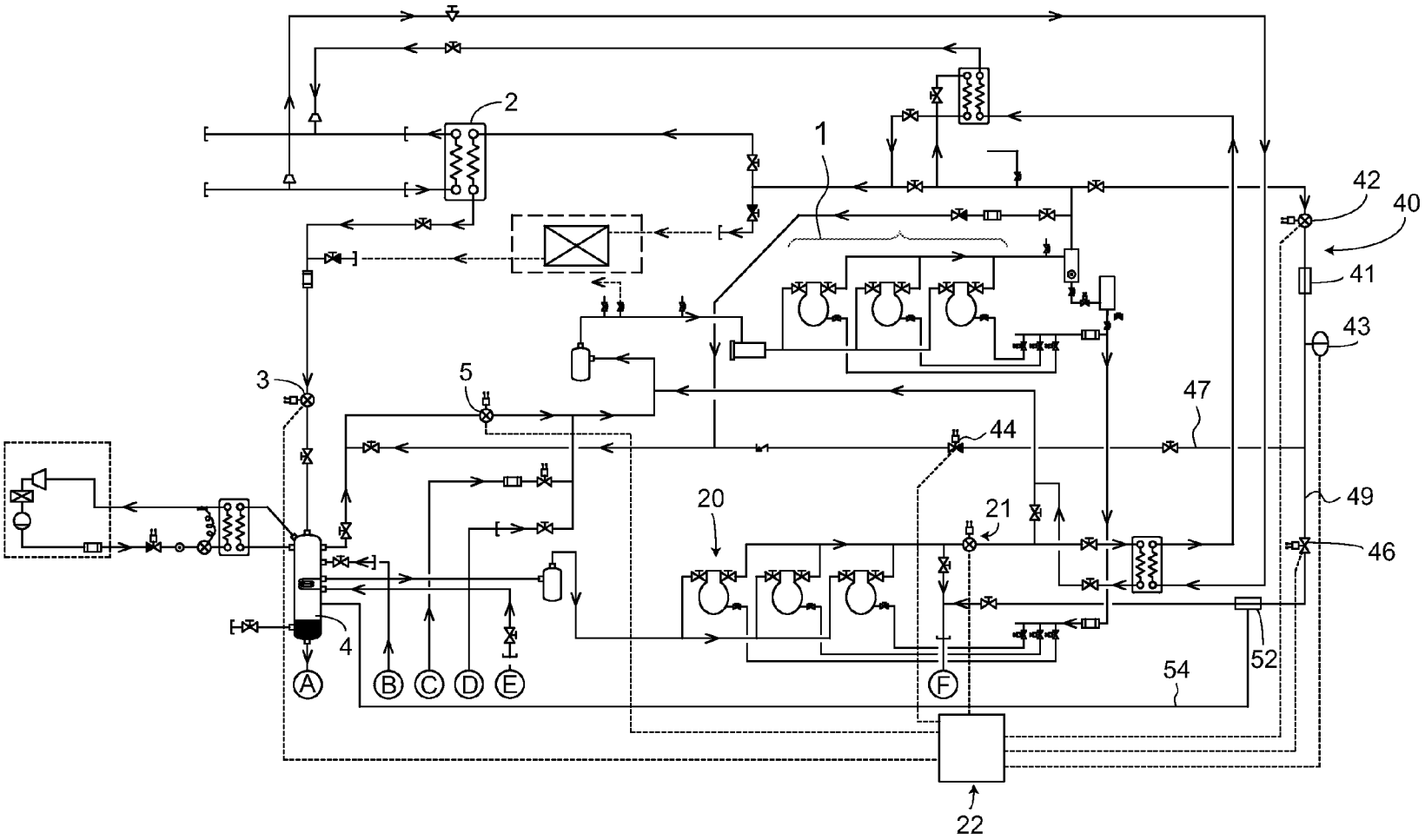
FIG. 4A is a further detailed schematic representation of a first portion of a CO2 refrigeration system having hot gas defrost and including a gas pressure management system.
Figure 4B:
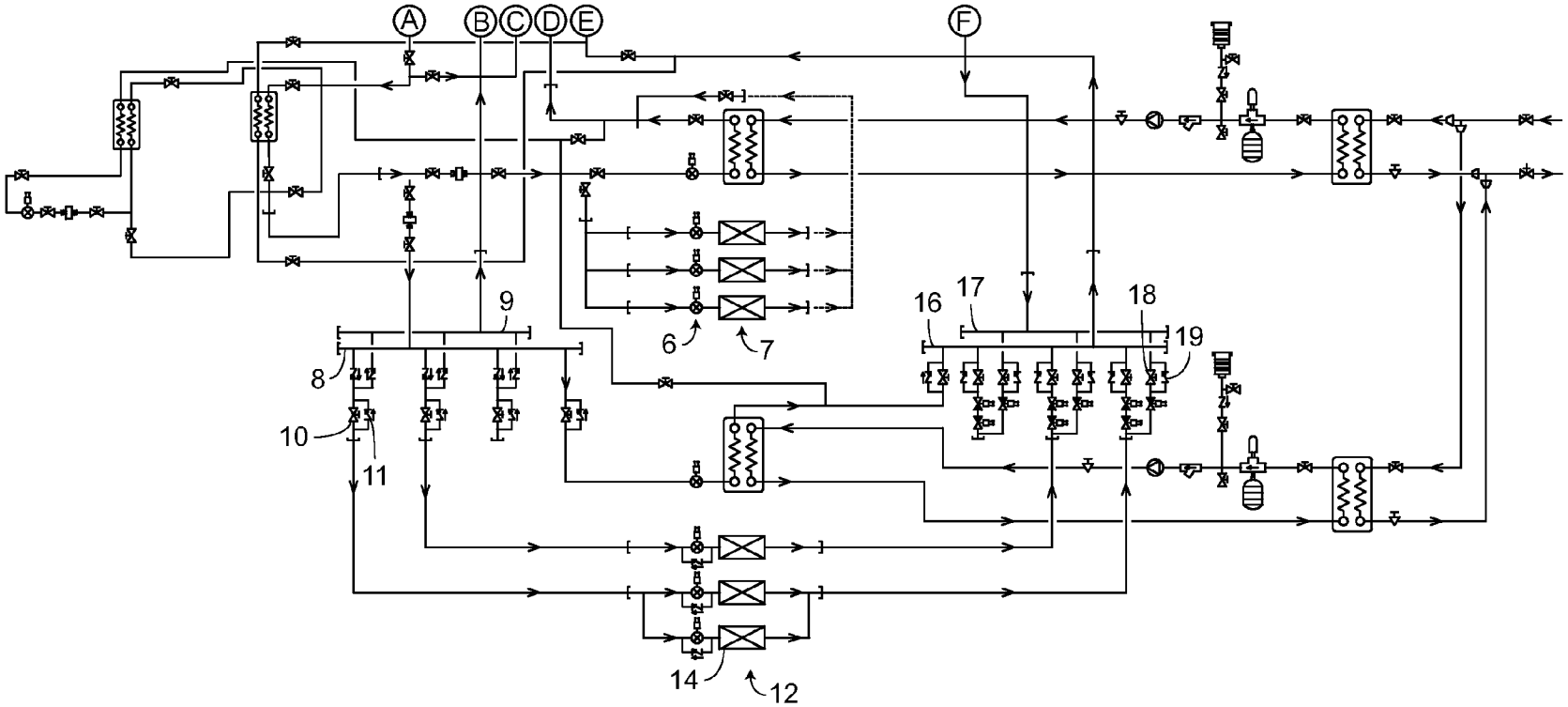
FIG. 4B is a schematic representation of a second portion of the CO2 refrigeration system of FIG. 4A.

Referring now to FIGS. 4A and 4B, a CO2 refrigeration system is shown with an LT system portion and an MT system portion, including a CO2 gas pressure management system 40 according to another embodiment. In this embodiment, the MT system portion includes MT compressors 1, which may be used to defrost the coils 14 of the LT evaporators 12. During a defrost cycle, the LT circuit flow path is reconfigured so that a portion of the CO2 refrigerant discharge hot gas (or in some embodiments, all the CO2 refrigerant discharge hot gas) from MT compressors 1 is directed through an MT defrost line 49 to a hot gas defrost header 17 and through a hot gas defrost valve 19 which is opened during defrost. According to one embodiment, MT defrost line 49 may be considered a high-pressure line (e.g. capable of withstanding the maximum CO2 pressure of approximately 120 bar, such as a steel pipe, etc.). In these embodiments, the CO2 discharge hot gas is directed in a reverse flow configuration from MT compressors 1, through MT defrost line 49, through hot gas defrost header 17 (which may be considered a low-pressure line, such as copper piping or tubing, etc.) and defrost valve 19, through the coils 14 of the LT evaporators 12 requiring defrost, then to defrost return manifold 9, to flash tank 4, and then back through flash gas bypass valve 5 to MT compressors 1 to complete the circuit. Inside the frosted coil 14 of the LT evaporators 12, the CO2 discharge hot gas is cooled and condensed as the frost on the evaporators 12 melts and absorbs heat from the CO2 refrigerant.

In exemplary embodiments, the CO2 gas discharged from the MT compressors 1 is superheated. As a result, the MT compressors 1 discharge the CO2 gas at a higher temperature than the gas discharged from the LT compressors 20. In some embodiments, the higher temperature gas may be better suited for use in the defrost cycle of the CO2 refrigeration system because it tends to melt the ice from the coils 14 more thoroughly, quickly and/or efficiently. However, the gas from the MT compressors 1 may also have a higher pressure than the CO2 gas discharging from the LT compressors 20. Control of the pressure in the MT defrost line is primarily provided by operational control of the MT compressors 1. However, if the pressure of the CO2 hot gas in the MT defrost line 49 is (or approaches a level that is) too high (e.g. greater than approximately 645 psi), and that pressure is allowed to propagate from the high-pressure piping of line 49 to the low-pressure piping of line 17 and the evaporators 12, the coils 14 or other components of the refrigeration system may become damaged or impaired. Therefore, the pressure of the high temperature CO2 gas in the MT defrost line 49 is monitored and secondarily managed by the CO2 gas pressure management system 40.

According to one illustrated embodiment of FIG. 4A, the gas pressure management system 40 includes a high pressure expansion valve 42 that is configured to regulate the pressure of the gas in the MT defrost line 49. When the CO2 refrigeration system is in defrost mode, the valve 42 receives a signal to open. At pressures substantially equal to or less than a lower limit (e.g. approximately 500 psig), the valve 42 is completely open, allowing the high temperature gas to continue through the MT defrost line 49. However, if/when the pressure of the gas rises above approximately 500 psi, the valve 42 is configured to modulate toward a closed position, gradually closing as the gas pressure reaches an upper limit (e.g. approximately 600 psig—corresponding generally to the pressure rating of the low-pressure piping of line 17 and the evaporators), and completely closing off the MT defrost line 49 at gas pressures at or above the upper limit.

The gas pressure management system 40 also includes a relief valve 41. According to one embodiment, the relief valve 41 is connected (i.e. vented) to the outside atmosphere, and is configured to open and release high temperature and high pressure CO2 gas from the MT defrost line 49 if the pressure reaches a level that is substantially equal to or above an external relief level (e.g. approximately 650 psi). According to other embodiments, relief valve 41 may be configured to discharge to a storage tank or other volume or repository to capture any discharge gas as a back-up pressure management device. The relief valve 41 is configured to act as a type of emergency release, decreasing the pressure of the CO2 gas within the MT defrost line 49 by releasing pressurized gas to a safe location outside of the CO2 refrigeration system. The relief valve 41 remains open until the pressure at the valve 41 decreases to a pressure substantially less than the external relief level, and then closes to prevent further release of CO2 from the system. A pressure transducer 43 is provided on MT defrost line 49 and is configured to measure the CO2 gas pressure in the MT defrost line 49 and provide an electronic signal representative of the actual pressure to control device 22 for control of the related components.

Referring further to the illustrated embodiment of FIG. 4A, the gas pressure management system 40 further includes a return line 47. The return line 47 is configured to return CO2 gas from the MT defrost line 49 back to the MT compressors 1 when the CO2 gas pressure increases to a level (e.g. an internal relief level) that is still below the pressure at which relief valve 41 will actuate (i.e. to provide "internal" pressure relief at a pressure of approximately 645 psig to avoid discharging CO2 from the system via relief valve 41). Return flow control of CO2 hot gas through return line 47 is provided by a defrost bypass valve 44, which is normally closed but is configured to open upon receiving a signal that pressure in the MT defrost line 49 has reached the internal pressure relief level (e.g. approximately 645 psig by way of example) and is approaching the actuation pressure for relief valve 41, as determined by transducer 43, which monitors the pressure of the CO2 gas within the MT defrost line 49. When the CO2 gas pressure reaches the internal pressure relief level (e.g. about 645 psig), the transducer 43 is configured to send a signal to the defrost bypass valve 44, opening the valve to allow the high pressure CO2 gas to return back to the suction of MT compressors 1 as a way to provide internal pressure control. The transducer 43 is also configured to send a 'close' signal to an isolation valve 46, located downstream along the MT defrost line 49 when the pressure in the MT defrost line reaches a predetermined level to prevent potential damage to the low-pressure line 17, coils 14 in evaporators 12 and other 'downstream' components. The isolation valve 46 is configured to close upon receiving the 'close' signal from the transducer 43 (e.g. when the CO2 gas pressure reaches a predetermined level, such as greater than approximately 651 psi), preventing the high pressure CO2 gas from traveling further along the MT defrost line 49. The high pressure CO2 gas is thus redirected through the open defrost bypass valve 44, and back to the MT compressors 1. Once the CO2 gas pressure is restored (i.e. reduced) to a predetermined level (such as approximately 600 psi or less in exemplary embodiments), the defrost bypass valve 44 closes, preventing gas from being recirculated back to the MT compressors 1. At this point, the stop valve 46 opens, again allowing hot CO2 gas to travel through the MT defrost line 49, and through line or header 17 and to the coils 14 during the defrost mode.

Referring further to FIGS. 4A and 4B, according to another embodiment, the gas pressure management system 40 may alternatively avoid use of a return line 47, and include a pressure relief valve 52 disposed on the low-pressure piping downstream of isolation valve 46. The pressure relief valve 52 may be provided with a setpoint that is lower than relief valve 41; for example, relief valve 52 may have a setpoint established at a level above a normal operating level, but still within the rating of the low-pressure piping portions of the system (e.g. within a range of approximately 600-650 psig for example). Relief valve 52 may be configured to direct any discharged CO2 gas through a relief line 54 to the flash tank or receiver 4, whereupon pressure in tank 4 may be managed by the MT compressors 1 via flash gas bypass valve 5.

Referring to FIGS. 1, 2 and 4A, a control system 22 (or other control device) is shown schematically that provides all the necessary control capabilities to operate the system during a normal refrigeration mode and during a defrost mode, according to an exemplary embodiment. The control system 22 interfaces with suitable instrumentation associated with the system, such as timing devices, pressure sensors, temperature sensors, etc. and provides appropriate output signals to components, such as valves, etc. to control operation of the system in the refrigeration and defrost modes. According to one embodiment, the control system 22 operates the flash gas bypass valve 5 to raise the pressure in the flash tank 4 during the defrost mode to obtain higher CO2 condensing pressure and temperature in the evaporator being defrosted for more effective defrost or to increase speed of the defrost mode. The control system 22 also coordinates the pressure regulation of the compressor discharge by the hot gas discharge valve 21 with the pressure regulation of the flash tank 4 by the flash gas bypass valve 5 such that the operation of the two valves 5 and 21 (and/or other suitable components) maintains a substantially constant differential pressure during the defrost operation (i.e. higher pressure to lower pressure) between the compressors 1 and 20 and the flash tank 4 to drive the flow of CO2 hot gas through the evaporators 7 being defrosted. According to any exemplary embodiment, the control system 22 contemplates methods, systems and program products on any machine-readable media for accomplishing various operations including those described herein. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

According to any preferred embodiment, systems and methods for providing and operating a hot gas defrost system in a CO2 refrigeration system having a LT system portion, or a MT system portion, or both, are shown and described. During the hot gas defrosting mode of operation, the discharge pressure on the LT compressor (single or multiple) 20 is controlled and raised using the hot gas discharge valve 21 and CO2 refrigerant hot gas is directed from the LT compressors 20 through the coil(s) of the defrosting LT evaporator 12 where full or partial condensation is realized and liquid CO2 refrigerant is returned to the flash tank 4 where pressure is controlled by the flash gas bypass valve 5. The hot gas discharge valve 21 operates to raise the compressor's discharge pressure above the pressure in the flash tank 4 to establish a system pressure differential (i.e. higher pressure to lower pressure) that directs the CO2 refrigerant from the compressor 1 or 20, through the defrosting LT and/or MT evaporators 7 (in either or a reverse or forward flow direction) and to the flash tank 4. Although shown as a single valve, the hot gas discharge valve 21 could be either a mechanical or an electrical valve and may include multiple valves in parallel, with a combination of mechanical and/or electrical control. For systems with multiple LT compressors, the hot gas discharge valve 21 operates during the defrost mode to increase the discharge pressure of only one, or multiple, or all of the LT compressors. The pressure setpoint of the flash gas bypass valve 5, which operates to regulate the pressure in the flash tank 4, is raised during the defrost mode of operation in order to obtain higher CO2 refrigerant condensing pressure and temperature in the evaporator(s) that are being defrosted for more effective defrosting or to increase the speed of (and reduce the time required by) the defrost cycle. The pressure regulation of the hot gas discharge valve 21 is coordinated with the pressure regulation of the flash gas bypass valve 5 such that the control of the two valves 5 and 21 maintains a constant differential pressure during the defrost operation, which serves to drive the flow of CO2 refrigerant discharge gas through the evaporator(s) being defrosted.

According to another preferred embodiment, system and methods for using hot CO2 discharge gas from the MT compressors 1 (alone or in combination with hot gas from the LT compressors 20) are provided to defrost coils in the LT evaporators. The pressure of the CO2 hot gas discharge from the MT compressors 1 is primarily controlled during the defrost mode by operational control of the MT compressors 1, and is secondarily managed within a predetermined range by a CO2 pressure management system that includes a first level of internal pressure relief and a second (higher) level of external pressure relief to prevent over-pressurization of components in the CO2 refrigeration system.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

It should be noted that the orientation of various elements may differ according to other exemplary embodiments, and that such variations are intended to be encompassed by the present disclosure.

It is also important to note that the construction and arrangement of the systems and methods for providing hot gas defrost on a CO2 refrigeration system as shown in the various exemplary embodiments is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter disclosed herein. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present invention as defined in the appended claims. The order or sequence of any process or method steps may be varied or re-sequenced according to alternative embodiments. Other substitutions, modifications, changes and omissions may be made in the design, operating conditions and arrangement of the various exemplary embodiments without departing from the scope of the present inventions.

What is claimed is:

1. A refrigeration system using a CO2 refrigerant, the system having an LT system portion with one or more LT compressors and one or more LT evaporators, and an MT system portion with one or more MT compressors and one or more MT evaporators, that operate in a refrigeration mode to cool the evaporators and a hot gas defrost mode that uses CO2 hot gas discharge from either the MT compressors, the LT compressors, or both the MT compressors and the LT compressors to defrost the LT evaporators, the system comprising:

a CO2 refrigerant circuit configured to direct the CO2 refrigerant through the refrigeration system, the CO2 refrigerant circuit comprising:

an LT compressor discharge line having a hot gas discharge valve;

a CO2 hot gas defrost supply header configured to direct the CO2 hot gas discharge from at least one of the LT compressors and the MT compressors to the LT evaporators;

a flash tank configured to supply CO2 refrigerant to the MT evaporators and the LT evaporators during the refrigeration mode, and to receive the CO2 hot gas discharge from the LT evaporators during the defrost mode;

a control system configured to regulate a position of the hot gas discharge valve during the defrost mode to direct the CO2 hot gas discharge through the LT evaporators and to the flash tank during the defrost mode.

2. The refrigeration system of claim 1, wherein the CO2 refrigerant circuit further comprises a first branch line having a first valve, the first branch line configured to direct CO2 hot gas discharge from the MT compressors to the CO2 hot gas defrost supply header.

3. The refrigeration system of claim 2, wherein the CO2 refrigerant circuit further comprises a second branch line having a second valve, the second branch line configured to direct CO2 hot gas discharge from the MT compressors to a suction of the LT compressors.

4. The refrigeration system of claim 3, wherein the control system is operable to open the first valve on the first branch line from the MT compressors to provide a back-up source of CO2 hot gas discharge to the CO2 hot gas defrost supply header when needed to supplement the CO2 hot gas discharge available from the LT compressors.

5. The refrigeration system of claim 4, wherein the control system is operable to open the second valve on the second branch line from the MT compressors to provide a source of CO2 refrigerant to a suction of the LT compressors during the defrost mode.

6. A CO2 refrigeration system having an LT system portion and an MT system portion, and having a hot gas defrost mode, the system comprising:

one or more compressors configured to discharge CO2 refrigerant in a high-pressure hot-gas state, the compressors operably coupled to a circuit for distribution of the CO2 refrigerant;

one or more heat exchangers configured to cool the CO2 refrigerant, and also configured to condense the CO2 refrigerant;

one or more evaporators operably coupled to the circuit, and configured to receive the CO2 refrigerant;

a plurality of valves connected to the circuit and positionable to establish a refrigeration flowpath and a defrost flowpath, wherein the defrost flowpath is arranged in a first direction, and the refrigeration flowpath is arranged in a second direction;

a flash tank operably coupled to the circuit and configured to receive a first portion of the CO2 refrigerant in a liquid state and a second portion of the CO2 refrigerant in a vapor state;

a hot gas discharge valve disposed in the circuit downstream of the compressor and configured to establish a first CO2 refrigerant pressure at the compressor's discharge during the defrost mode;

a flash gas bypass valve disposed in the circuit downstream of the flash tank and operable to establish a second CO2 refrigerant pressure in the flash tank during the defrost mode; and a control system configured to regulate the hot gas discharge valve and the flash gas bypass valve during the defrost mode, to maintain a differential pressure between the first and second CO2 refrigerant pressures, and to drive the flow of CO2 refrigerant in the high-pressure hot-gas state from the compressors and through the evaporators.

7. The CO2 refrigeration system of claim 6, wherein the second CO2 refrigerant pressure in the flash tank during the defrost mode is sufficient to maintain a saturation temperature of the CO2 refrigerant in the evaporators at a temperature of at least approximately 34° F.

8. The CO2 refrigeration system of claim 6, wherein during the defrost mode one or more compressors are configured to deliver hot gas through the evaporators until full or partial condensation is realized and liquid is returned to the flash tank.

9. The CO2 refrigeration system of claim 6, wherein the hot gas discharge valve is configured to raise the first CO2 refrigerant pressure to a higher pressure than the second CO2 refrigerant pressure.

10. The CO2 refrigeration system of claim 6, wherein the LT system portion comprises more than one LT compressors, and wherein the hot gas discharge valve is configured to raise the discharge pressure of one or more of the LT compressors.

11. The CO2 refrigeration system of claim 6, wherein the flash gas bypass valve is configured to raise the second CO2 refrigerant pressure during the defrost cycle.

12. The CO2 refrigeration system of claim 6, wherein the MT system portion further comprises one or more MT compressors having a suction and a discharge, and configured to defrost the evaporators within the LT system portion during defrost mode by delivering hot gas from the discharge to the LT system portion.

13. The CO2 refrigeration system of claim 12, further comprising a first valve configured to receive hot gas from the discharge of one or more MT compressors and to deliver the hot gas to an LT compressor discharge.

14. The CO2 refrigeration system of claim 12, further comprising a second valve configured to receive hot gas from the discharge of one or more MT compressors and to deliver the hot gas to an LT compressor suction.

15. A CO2 refrigeration system having an LT system portion with one or more LT compressors and one or more LT evaporators, and an MT system portion with one or more MT compressors and one or more MT evaporators, and having a hot gas defrost mode of operation that uses CO2 hot gas discharge from the MT compressors to defrost the LT evaporators, the system comprising:

a defrost circuit configured to direct the CO2 hot gas discharge from the MT compressors to the LT evaporators during the hot gas defrost mode;

an expansion valve operably coupled to the defrost circuit, configured to open during the defrost mode, and configured to regulate the pressure of the CO2 hot gas discharge within the defrost circuit;

a relief valve operably coupled to the defrost circuit, and configured to release at least some of the CO2 hot gas discharge from the defrost circuit;

instrumentation operably coupled to the defrost circuit, and configured to monitor the pressure of the CO2 hot gas discharge within the defrost circuit, and configured to transmit one or more signals;

an isolation valve operably coupled to the defrost circuit, and configured to receiving a signal from the instrumentation;

a return line fluidly connecting the defrost circuit to a suction of the MT compressors;

a defrost bypass valve operably coupled to the return line, and configured to receive a signal from the instrumentation;

a control system operably communicating with the instrumentation and the isolation valve and the defrost bypass valve to prevent the CO2 hot gas discharge having a pressure above a predetermined point from reaching the LT evaporators.

16. The CO2 refrigeration system of claim 15, wherein during the defrost mode, the expansion valve is configured to open and remain open when the pressure of the CO2 hot gas discharge is substantially equal to or less than a lower limit, and is configured to close and remain closed when the pressure of the CO2 hot gas discharge is substantially equal to or greater than an upper limit, and is configured to modulate between an open position and a closed position when the pressure of the CO2 hot gas discharge is between the lower limit and the upper limit.

17. The CO2 refrigeration system of claim 15, wherein the relief valve is configured to open and release gas from the defrost circuit when the CO2 hot gas discharge pressure is substantially equal to or above an external relief level, and to close when the CO2 hot gas discharge pressure is lower than the external relief level.

18. The CO2 refrigeration system of claim 15, wherein the defrost bypass valve is configured to open and the isolation valve is configured to close so that the CO2 hot gas discharge is directed to a suction of the MT compressors when the CO2 hot gas discharge pressure is substantially equal to or greater than an internal relief pressure, and wherein the defrost bypass valve is configured to close and the isolation valve is configured to open so that the CO2 hot gas discharge is directed to the LT evaporators when the CO2 hot gas discharge pressure is substantially less than the internal relief pressure.

19. A CO2 refrigeration system having an LT system portion having a low-pressure piping portion and with one or more LT compressors and one or more LT evaporators, and an MT system portion having a high-pressure piping portion and with one or more MT compressors and one or more MT evaporators, and having a hot gas defrost mode of operation that uses CO2 hot gas discharge from the MT compressors to defrost the LT evaporators, the system comprising:

a defrost circuit configured to direct the CO2 hot gas discharge from the MT compressors to the LT evaporators during the hot gas defrost mode;

a valve operably coupled to the defrost circuit, configured to open during the defrost mode, and configured to regulate the pressure of the CO2 hot gas discharge within the defrost circuit; and a relief valve operably coupled to the defrost circuit, and configured to release at least some of the CO2 hot gas discharge from the defrost circuit upon detection of a predetermined pressure in the defrost circuit.

20. The CO2 refrigeration system of claim 19, wherein the relief valve is disposed within the high-pressure piping portion and configured to direct CO2 hot gas discharge to at least one of the atmosphere, a storage volume and a suction of the MT compressors.

21. The CO2 refrigeration system of claim 19, wherein the relief valve is disposed within the low-pressure piping portion and configured to direct CO2 hot gas discharge to at least one of the atmosphere, a storage volume and a flash tank operably associated with a suction of the MT compressors.

* * * * *